US005427045A

United States Patent [19]

Fetchko

[11] Patent Number: 5,427,045

[45] Date of Patent: Jun. 27, 1995

[54] STEERING CYLINDER WITH INTEGRAL SERVO AND VALVE

[75] Inventor: Eric B. Fetchko, Burnaby, Canada

[73] Assignee: Teleflex (Canada) Ltd., Richmond, Canada

[21] Appl. No.: 330,853

[22] Filed: Oct. 27, 1994

Related U.S. Application Data

[63] Continuation of Ser. No. 128,690, Sep. 30, 1993, abandoned.

[51] Int. Cl.[6] ..... B65H 25/00

[52] U.S. Cl. ..... 114/150; 60/385; 440/61

[58] Field of Search ..... 114/150; 440/61; 60/385, 386

[56] References Cited

U.S. PATENT DOCUMENTS

| | | | |
|---|---|---|---|
| 3,080,721 | 3/1963 | Mettetal, Jr. | 114/150 X |
| 3,631,833 | 1/1972 | Shimanckas | 115/18 |
| 4,592,732 | 6/1986 | Ferguson | 440/61 |
| 4,595,370 | 8/1985 | Small | 440/53 |
| 4,744,777 | 5/1988 | Ferguson | 440/61 |
| 4,892,494 | 1/1990 | Ferguson | 440/61 |
| 4,976,639 | 12/1990 | Rawlings et al. | 440/59 |
| 5,213,527 | 5/1993 | Fetchko | 440/61 |
| 5,289,756 | 3/1994 | Kobelt | 91/368 |

FOREIGN PATENT DOCUMENTS

| | | | |
|---|---|---|---|
| 0550264 | 7/1993 | European Pat. Off. | 114/150 |
| 3922669 | 2/1990 | Germany . | |
| 9212896 | 9/1992 | WIPO . | |
| 9217369 | 10/1992 | WIPO . | |
| 9219494 | 11/1992 | WIPO . | |

OTHER PUBLICATIONS

Volvo Brochure, Installation Instructions Hydraulic Steering for Servo Cylinders Kit No. 1140585-9.
SEASTAR Hydraulics—Order Guide, pp. 23, 24 & 30.
OMC 1989 Owner's Manual, pp. 9-8 and 9-9.
1984 Quicksilver Accessories Guide.
Sleipner Motors A.S.—Steering Power.

*Primary Examiner*—Sherman Basinger
*Attorney, Agent, or Firm*—Norman M. Cameron

[57] ABSTRACT

A power steering apparatus for a marine craft includes an actuator assembly including a hydraulic steering actuator. The steering actuator is operatively connected to the tiller of the craft. A hydraulic servo actuator is mounted on the steering actuator. The servo actuator is permitted limited axial displacement relative to the steering actuator. The servo actuator is operatively connected to the steering actuator. A servo valve is mounted on the actuator assembly and has ports for receiving pressurized hydraulic fluid. The servo valve is hydraulically connected to the steering actuator. A member operatively connects the servo valve to the servo actuator. Displacement of the servo actuator opens the valve to provide pressurized hydraulic fluid to the steering actuator. The steering actuator includes a steering cylinder, a piston reciprocatingly received in the cylinder, a piston rod connected to the piston and end fittings on each end of the cylinder. The mechanism for mounting the servo actuator includes a mount integral with each of the end fittings.

22 Claims, 8 Drawing Sheets

STEERING CYLINDER WITH INTEGRAL SERVO AND VALVE

This is a continuation of Ser. No. 08/126,690 filed Sep. 30, 1993, and now abandoned.

BACKGROUND OF THE INVENTION

This invention relates to marine craft and steering systems therefor, in particular steering systems using an integral steering cylinder, servo and valve.

DESCRIPTION OF RELATED ART

Power steering systems arc commonly used on marine craft such as larger pleasure craft. One type of power steering system is a hydraulically actuated, follower type power steering system and is often used on pleasure craft with inboard mounted engines. One or more hydraulic steering actuators arc connected to the tiller arms of the vessel. Hydraulic lines connect the helm and a hydraulic pump to a sequence valve. If the valve senses that there is sufficient hydraulic pressure from the pump, then the system operates in a power mode. If not, then the system operates in a manual mode. In the power mode, hydraulic fluid is pumped by the helm to a hydraulic servo actuator. This causes the cylinder of the servo actuator to shift. The cylinder is connected to a servo valve which opens when the servo cylinder shifts. This supplies the hydraulic steering actuator with pressurized hydraulic fluid from the pump via the sequence valve. In one type of system, the rod of the servo actuator is connected to the tiller arm. When the steering actuator moves the tiller arm, this causes the servo actuator to move, closing the servo valve. Thus the tiller arm only moves incremently as the helm is turned.

In the manual mode, the hydraulic fluid is pumped manually from the helm through the sequence valve to the servo actuator and power actuator. This provides manual backup steering in the event of power source failure. Significantly more turns of the helm are required in order to steer the craft a desired amount compared to the power mode. A number of problems have been encountered with earlier power steering systems of this type. For example, some earlier systems have employed a multiplicity of hydraulic hoses connecting together the sequence valve, servo valve, servo actuator and steering actuator. These hoses arc prone to leakage, abrasion and other types of failure.

Another difficulty occurs because the servo actuator and steering actuator are separately mounted and connected to the tiller arm. This requires careful adjustment in order to have the system work correctly. If not installed correctly, a situation can occur where the steering cylinder cannot catch up, thereby causing the hydraulic pump to pump full flow across its pressure release, creating large amounts of heat and possibly damaging the pump. There are also several sets of tolerances which must be carefully observed to ensure that the system operates correctly. These include servo actuator manufacturing tolerances relating to stroke, steering actuator tolerances regarding stroke and mounting tolerances of both actuators in relation to the tiller arm or arms.

Units with an integral steering cylinder and servo cylinder were previously known and even units with an integral servo valve as well, for example as sold by Volvo in their Kit No. 1140585-9. However prior art units are not as easily mounted, as simple and free from moving out of adjustment due to vibrations and the like, as optimally desired.

Accordingly, it is an object of the invention to provide an improved hydraulic steering system for marine craft which overcomes the problems associated with earlier systems of the type.

It is another object of the invention to provide an improved marine hydraulic steering system which is simpler to install and is less dependent upon establishing careful tolerances at various points on the system.

It is also an object of the invention to provide an improved marine steering system wherein the number of hydraulic hoses is minimized to reduce the possibility of abrasion and leakage of hydraulic fluid.

It is a further object of the invention to provide an improved marine hydraulic steering system where the relationship between various components can be set up in advance and where the components are less likely to shift due to vibrations and forces encountered during use.

SUMMARY OF THE INVENTION

In accordance with these objects, a power steering apparatus for a marine craft has an actuator assembly including a hydraulic steering actuator. There is means for mounting the steering actuator on the craft and means for operatively connecting the steering actuator to the tiller thereof. The assembly also includes a hydraulic servo actuator, means for mounting the servo actuator on the steering actuator, means for permitting limited axial displacement of the servo actuator relative to the steering actuator and means for mechanically connecting the servo actuator to the steering actuator. A servo valve is mounted on the actuator assembly and has means for receiving pressurized hydraulic fluid. There is means for connecting the valve hydraulically to the steering actuator and the servo actuator. A member mechanically connects the valve to the servo actuator, whereby displacement of the servo actuator opens the valve to provide pressurized hydraulic fluid to the steering actuator. The steering actuator includes a steering cylinder, a piston reciprocatingly received in the cylinder, a piston rod connected to the piston and end fittings on each end of the cylinder. The means for mounting the servo actuator includes a mount integral with each of the end fittings. The mount may include sockets for receiving the ends of the servo actuator.

The means for mechanically connecting the servo actuator to the steering actuator may include means for connecting the piston rod of the servo actuator to the piston rod of the steering actuator adjacent the outer ends thereof. The means for connecting may include a connector having spaced-apart apertures, the rod of the servo actuator being received through a first said aperture and the rod of the steering actuator being received through a second said aperture.

In one preferred example of the invention, the servo actuator includes a cylinder with a circumferential exterior groove. The member is secured to the cylinder by having an aperture fitted about the groove.

The invention overcomes problems associated with the prior art by providing an integral steering actuator, servo actuator and servo valve which can be mounted in the marine craft as a unit, fully pro-adjusted, thus making mounting much simpler. The number of hydraulic lines can be significantly reduced at the same time. The preferred mounting system also is simple and reliable and the servo cylinder is not subject to becoming maladjusted due to vibrations and the like. The preferred means of mechanically connecting the valve to the servo actuator also is secure and not likely to become displaced by external forces or vibrations. Moreover, the preferred means for mechanically connecting the servo actuator to the steering actuator again resists loosening due to vibrations.

DESCRIPTION OF THE PREFERRED EMBODIMENTS

Figure 1:
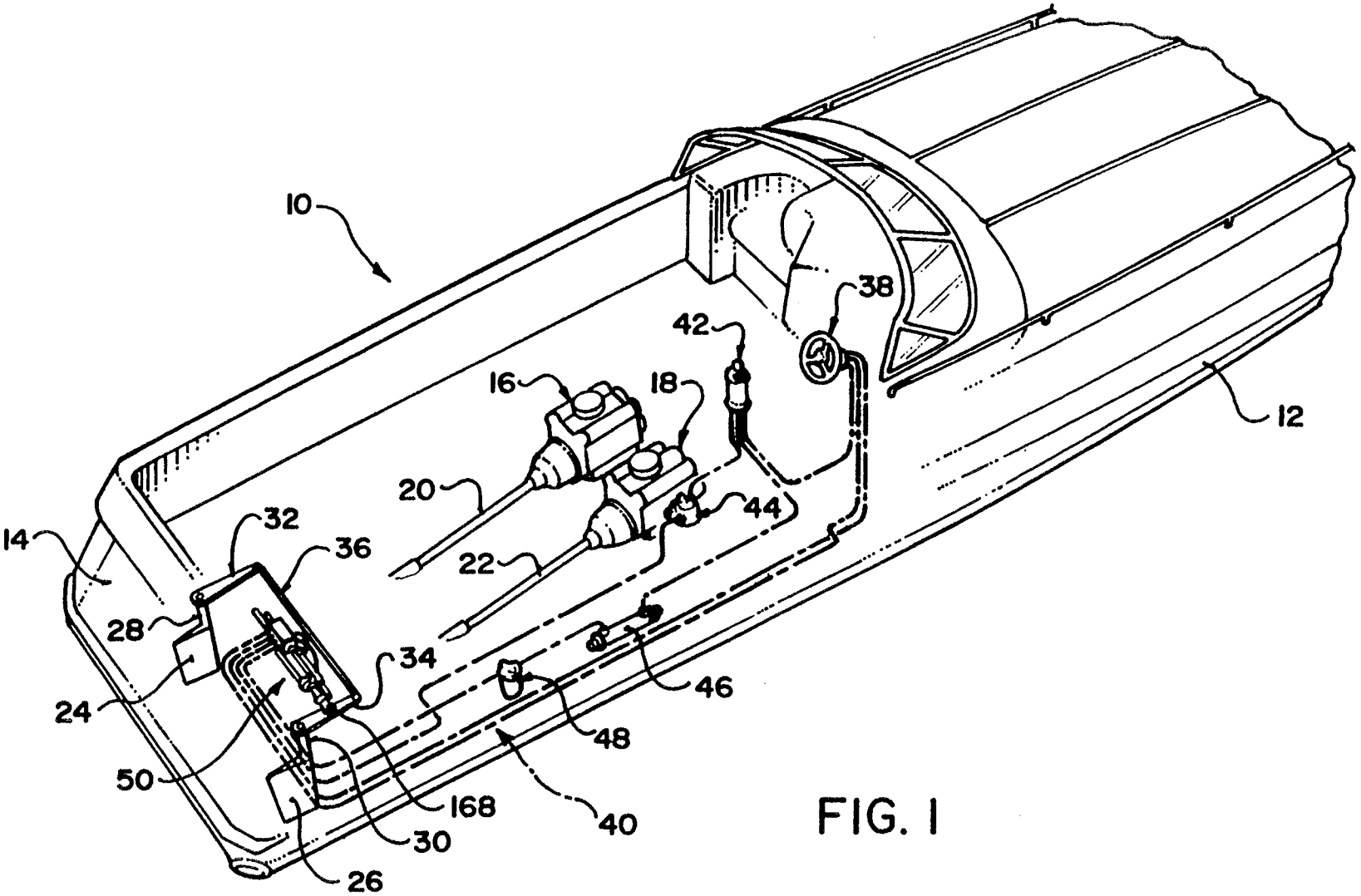
FIG. 1 is a top, side isometric view showing a marine craft in ghost with internal components, including a hydraulic steering apparatus, according to the invention, the craft being partly broken away.

Referring first to FIG. 1, this shows a marine craft 10 having a hull 12 and a stern 14. The illustrated craft is a relatively large pleasure craft having a pair of inboard engines 16 and 18 coupled to propeller shafts 20 and 22 respectively. This particular craft is steered by a pair of rudders 24 and 26 mounted on rudder shafts 28 and 30 respectively. The shafts arc connected to tiller arms 32 and 34 which are connected together by a tie rod 36 pivotally connected to each of the tiller arms in a known manner. The craft is provided with a helm 38 which is used to steer the craft via a hydraulic steering system shown generally at 40. It should be understood that the invention is applicable to other types of craft as well with other types of drive systems such as a single inboard engine, an outboard engine or an inboard/outboard engine. It is also applicable to vessels having a single rudder for example.

The steering system 40 also includes, besides the helm 38, a main hydraulic fluid reservoir 42, a hydraulic pump 44, an oil cooler 46, an oil filter 48 and integral steering actuator, servo actuator and servo valve assembly 50.

Figure 7:
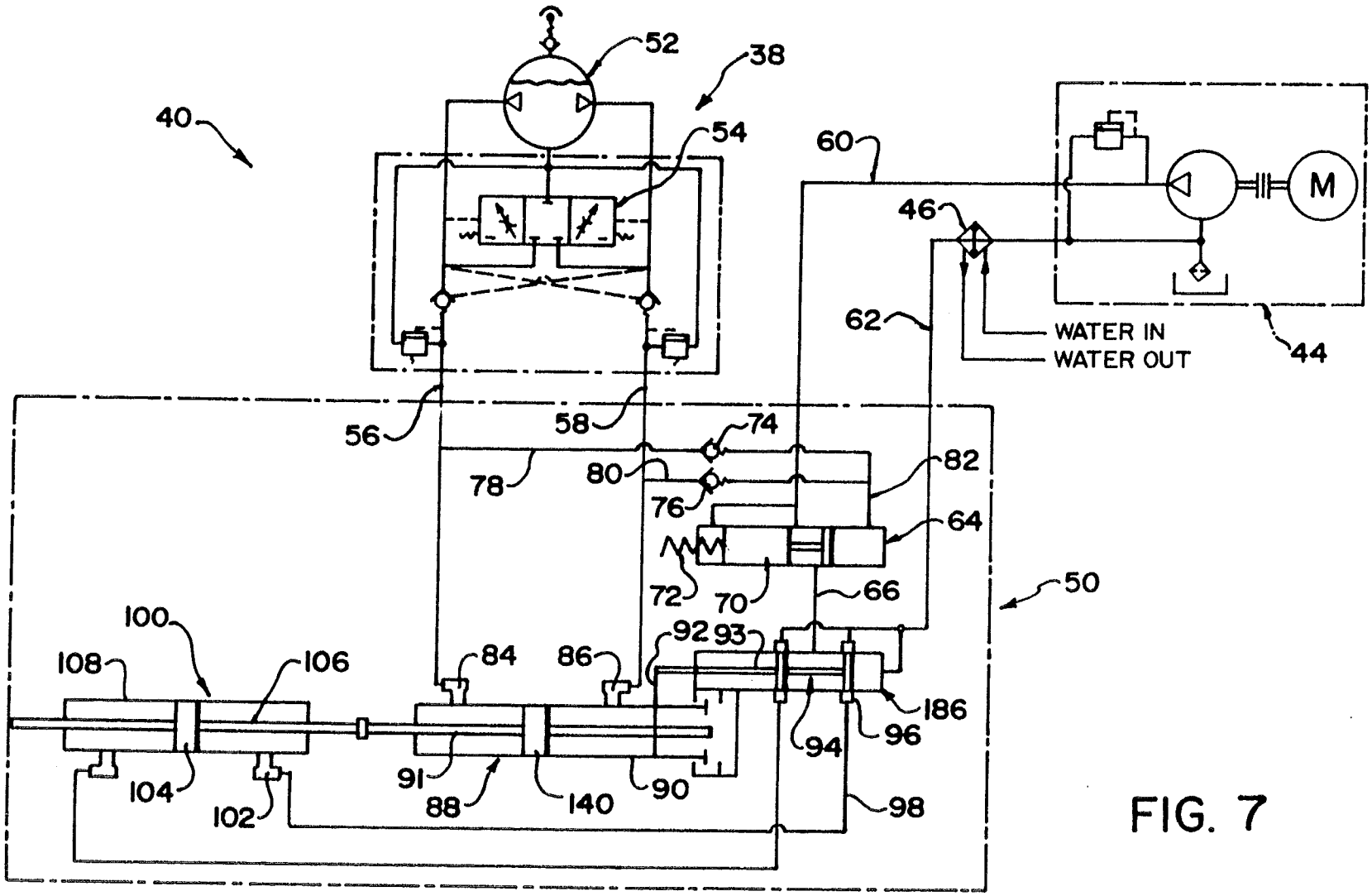
FIG. 7 is a schematic diagram of a power steering system according to an embodiment of the invention.

The hydraulic steering system 40 is shown schematically in FIG. 7. The helm is equipped in the conventional manner with helm pump 52 equipped with a lock valve 54. The lock valve holds the helm in position unless it is manually turned. There are two hydraulic lines 56 and 58 through which hydraulic fluid is pumped from the helm or returns to the helm depending upon the direction the helm is turned. For example, if the helm is rotated clockwise, then fluid is pumped away from the helm through hydraulic line 58 and returns to the helm through hydraulic line 56.

Hydraulic pump 44 is conventional. The one illustrated in FIG. 1 is driven by engine 18 although the pump could be electrically driven for example. Hydraulic line 60 carries pressurized hydraulic fluid discharged from the pump 44, while line 62 through oil cooler 46 serves to return fluid to the pump. Hydraulic line 60 is connected to selector valve 64.

In normal operation in the power mode, pressurized hydraulic fluid enters the selector valve through line 60 and leaves the valve through line 66 which is connected to servo valve 186. The pressurized fluid in line 60 travels through spool 70 while hydraulic pressure and spring force keep the spool to the right. In the event of failure of pump 44, the spool moves to the left. The pressure of fluid from the helm pump in lines 56 or 58, depending upon the direction the helm is turned, unseats check valve 74 or 76 through lines 78 or 80. The fluid from the helm pump passes through line 82, through the selector valve to line 66 and thus to the servo valve 186 and from there to the steering actuator. This is the manual mode of operation.

The hydraulic lines 56 and 58 from the helm are connected to ports 84 and 86 of servo actuator 88. As described below in more detail, the pressurized fluid from the helm pump moves cylinder 90 of actuator 88 to the left or to the right depending upon whether line 56 or line 58 is pressurized by the helm. There is a member 92 connecting cylinder 90 to rod 93 of the servo valve spool 94. Thus, when the cylinder 90 is deflected it moves the valve spool in the same direction. If, for example, the helm is turned clockwise, line 58 is pressurized and cylinder 90 is deflected to the right from the center position shown. This moves valve spool 94 of the servo valve to the right as well. This allows pressurized hydraulic fluid from pump 44 entering the servo valve through line 66 to exit the valve through port 96 and line 98. The fluid from the pump enters steering actuator 100 through port 102 thereof. Piston 104 of the steering actuator and rod 106 connected thereto are thereby moved to the left from a point of view of the drawing. Rod 106 of the steering actuator is operatively connected to rod 91 of the servo actuator. For example, in some prior art both rods are connected to the tiller arm. Thus servo actuator 88 is moved to the left, restoring spool 94 of the servo valve to its original position and stopping a flow of pressurized hydraulic fluid to the steering actuator from port 96. Therefore, after the helm is turned, the rudder connected to the steering cylinder is turned a specific amount and stops in that position until the helm is again turned in one direction or the other. As described thus far, the steering system is generally conventional.

Figure 2:
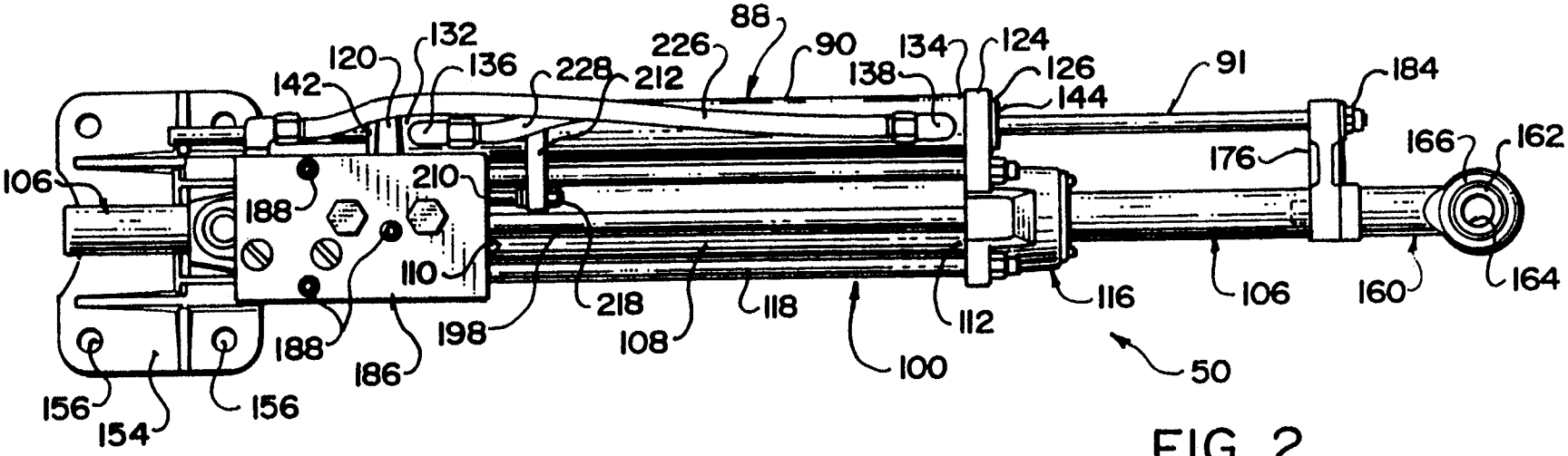
FIG. 2 is a top plan view of a power steering apparatus according to an embodiment of the invention.
Figure 3:
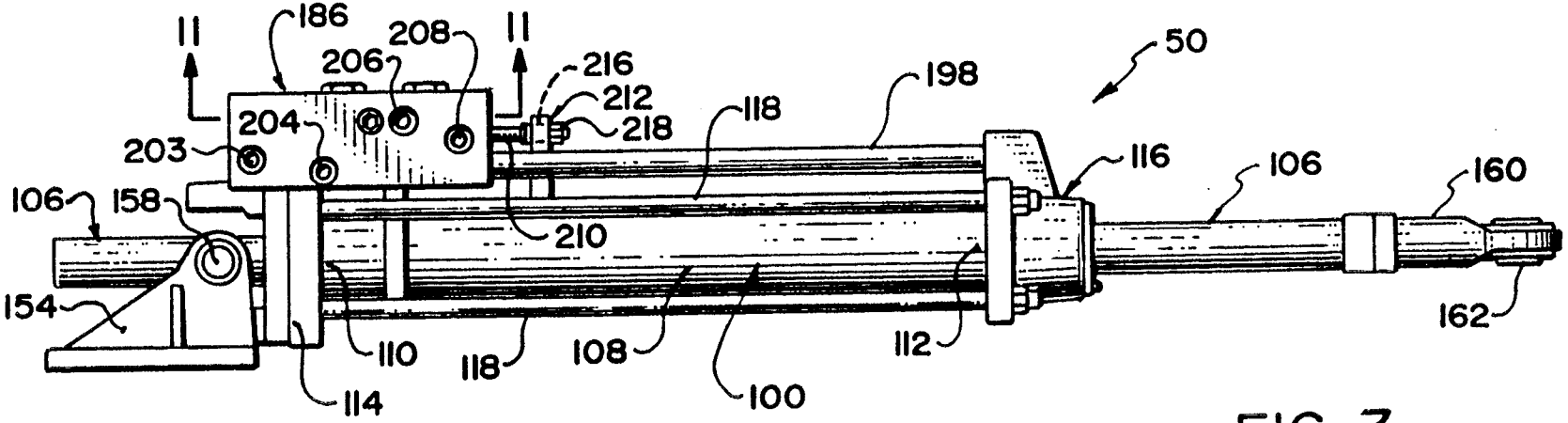
FIG. 3 is a side elevation of the embodiment of FIG. 2.
Figure 4:
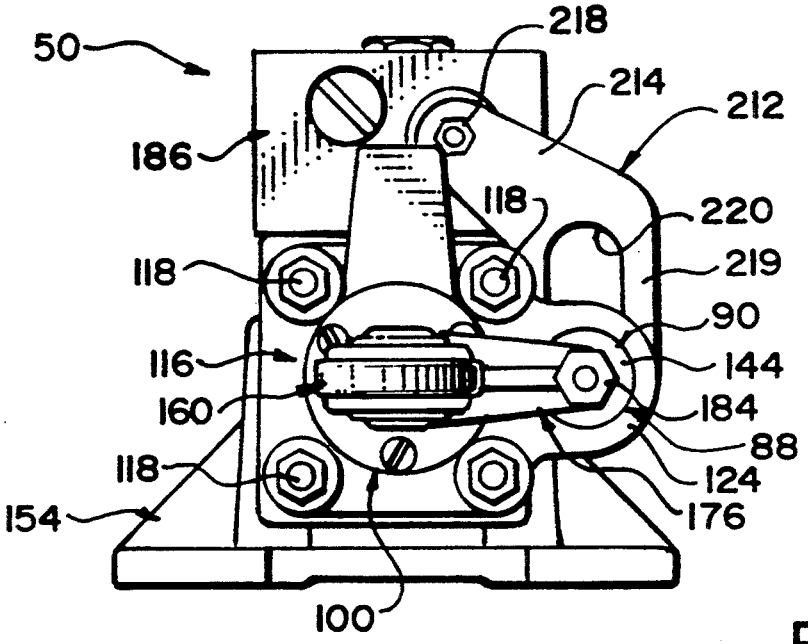
FIG. 4 is a end view of the embodiment of FIG. 2.

The invention departs from the prior art however in the nature of the integral steering actuator, servo actuator and servo valve assembly 50 best seen in FIG. 2–6. Referring first to FIG. 2–4, steering actuator 100 is conventional in most respects and includes a cylinder 108 having a first end 110 and a second end 112. There is an end fitting 114 at the first end and an end fitting 116 at the second end, also shown in FIG. 5 and 6. The end fittings are secured together by four tie rods 118 in the conventional manner. However, the fittings themselves are not conventional in so far as they include integral mounts 120 and 124 for servo actuator 88. The mounts are substantially the same and are in the form of U-shaped projections on the sides of the end fittings as best seen for mount 124 in FIG. 4. The mount 124 has an aperture 126 therein which is circular in this embodiment. Mount 120 has a similar aperture 128, shown in FIG. 5. In this embodiment each end fitting and its associated mount forms a one piece brass casting. Alternatively, the mounts and end fittings could be made of other materials and fabricated in other ways besides casting.

The mounts 120 and 124 serve to secure servo actuator 88 to the steering actuator 100. Like the steering actuator, the servo actuator is generally conventional and cylinder 90 has a first end 132 and a second end 134 as seen best in FIG. 5. There are ports 136 and 138 adjacent each end for receiving or discharging hydraulic fluid as seen in FIG. 2. The actuator has a piston 140 reciprocatingly received within the cylinder and connected to the rod 91 as shown in FIG. 5.

Figure 5:
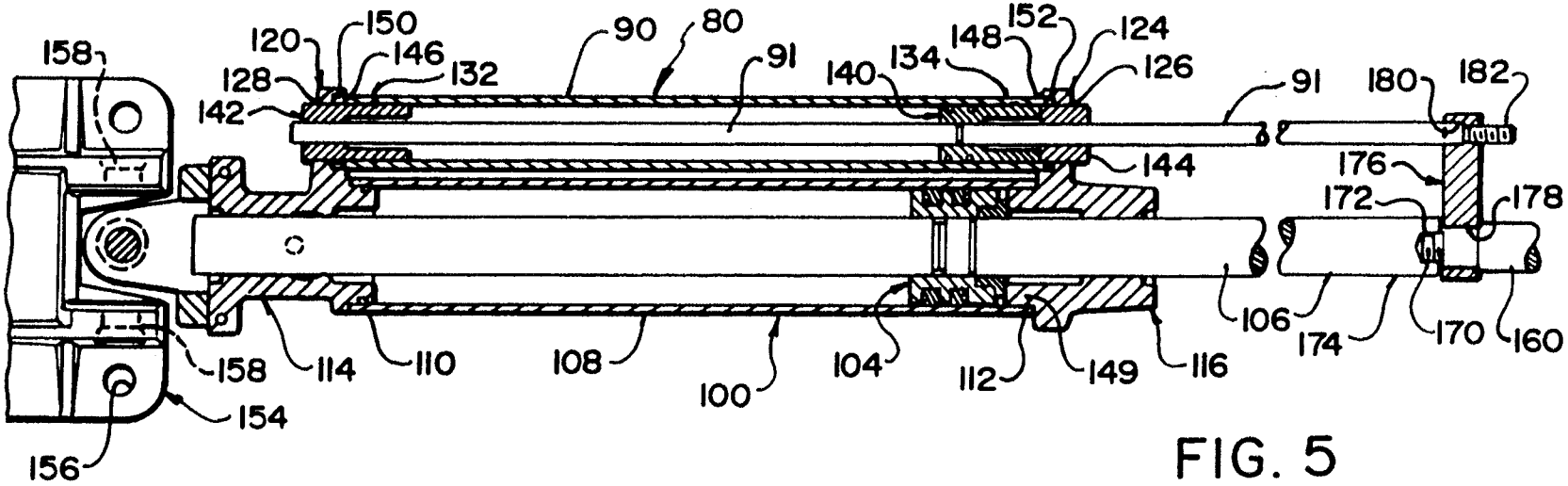
FIG. 5 is an enlarged plan view thereof, partly in section and shown without the valve.

The cylinder has end portions 142 and 144 adjacent the first and second ends thereof As best seen in FIG. 5, these end portions each have a slightly reduced diameter compared to the major portion of the cylinder therebetween. These portions of the cylinder are sized to fit slidably in the apertures 126 and 128 of the mounts which serve as sockets co-axial with the cylinder. FIG. 4 shows end portion 144 projecting through aperture 126 on one end of the servo cylinder for example. As seen in FIG. 5, there are shoulders 146 and 148 where the end portions 142 and 144 of reduced diameter join the rest of the servo cylinder 130. The mounts 126 and 128 have corresponding shoulders 147 and 149 formed by annular recesses on the inner sides thereof, forming sockets which are slightly larger in diameter than the apertures 126 and 128. The distance between the shoulders 147 and 149 on the mounts is slightly greater than the distance between shoulders 146 and 148 on the servo cylinder. Accordingly, the cylinder can be displaced a limited amount in the axial direction parallel to its rod 91 between the shoulders 147 and 149 on the mounts. In FIG. 5, the cylinder 130 is shown in its center position with a gap 150 between shoulder 147 of the mount and shoulder 146 of the cylinder and a similar gap 152 between shoulder 149 of the mount and shoulder 148 of the cylinder. Thus it is clear that the servo cylinder 130 can be displaced either to the right or to the left, from the point of view of FIG. 5, the amount of gaps 150 and 152. The maximum amount of displacement is 0.15 inches in this embodiment although this can be altered to suit the configuration of a particular steering system. The steering actuator 100 is mounted in the stern of the craft 10 by means of a bracket 154 having a plurality of bolt holes 156 for receiving bolts, as seen in FIG. 2 and 5, to connect the bracket to the hull of the craft. The bracket is pivotally connected to the steering cylinder by means of recessed, socket-head bolts 158 on each side thereof, as seen in FIG. 5. The use of the recessed bolts 158 allows clearance/or rod 91 of servo actuator 88. Accordingly, the rod 91 of the servo cylinder has a line of action passing through the centers of the bolts 158 along with the line of action of the steering cylinder, as best seen with reference to FIG. 3 and 4. Because the servo cylinder is not offset with respect to the axis formed by the centers of the bolts 158, the bolts are in pure sheer instead of being combined with bending moments which would increase the stress thereon.

Figure 6:
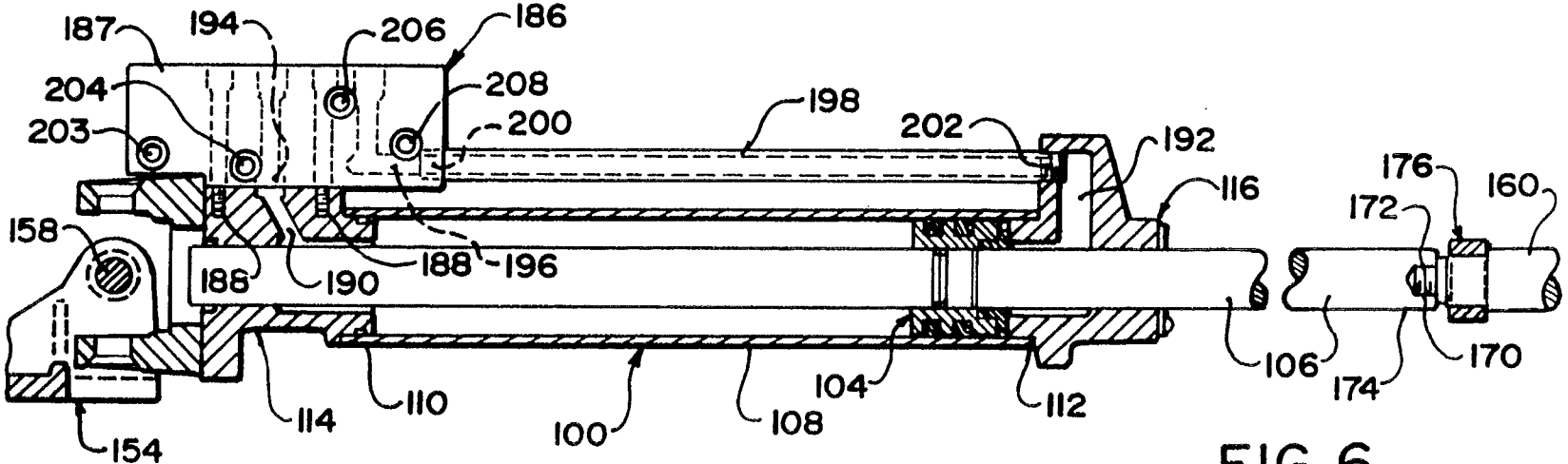
FIG. 6 is an enlarged side elevation thereof, partly in section.

The steering cylinder is pivotally connected to the tiller arm by means of a fitting 160 having a ball 162 with an aperture 164 received in a socket 166. A bolt 168, shown in FIG. 1, fits through aperture 164 to pivotally connect the steering actuator to tiller arm 34. The fitting 160 has a male threaded portion 170 threadedly received within a corresponding female threaded aperture 172 in outer end 174 of the rod 106. This is best shown in FIGS. 5 and 6. A connecting member 176 has a first aperture 178. Fitting 160 fits into the aperture and secures the connecting member against the outer end of rod 106 when the fitting 160 is tightened onto the rod.

The connecting member 176 has a second aperture 180 which receives threaded outer end 182 of servo rod 91. A nut 184, shown in FIG. 2 and 4, secures the connecting member to rod 91. Thus the member 176 connects servo rod 91 to steering rod 106 such that the rods move together.

Servo valve 186 with a body 187 is mounted on the steering actuator 100 adjacent its first end 110. The mounting is accomplished by means of bolts 188 threadedly received by the end fitting 114 as shown in FIG. 6. The steering cylinder 108 has a port 190 adjacent its first end and second port 192 adjacent its second end. The ports receive or discharge pressurized hydraulic fluid depending upon the direction of movement of piston 104. The servo valve 186 has a port 194 communicating directly with port 190 of the cylinder without any requirement for a hydraulic hose or the like therebetween. The valve 186 has another port 196 which communicates with port 192 through a rigid, tubular conduit 198 extending parallel to the cylinder 108. The conduit 198 has threaded ends 200 and 202 threadedly received within body 187 of valve 186 and end fitting 116 respectively. In this example the conduit 198 is of stainless steel although other materials could be substituted. The valve also has ports 203 and 204 connected to the helm, port 206 receiving pressurized fluid from pump 44 and port 208 connected to the reservoir.

Figure 10:
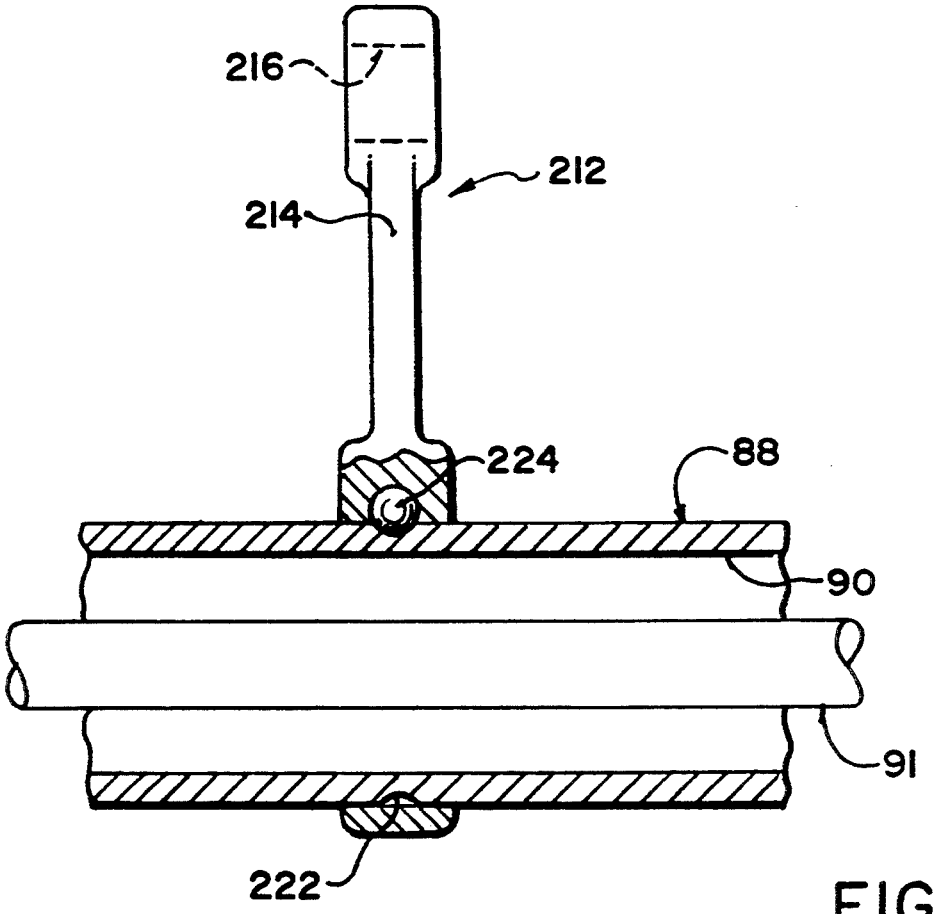
FIG. 10 is a top plan view of the member for connecting the servo valve to the servo cylinder of the embodiment of FIG. 1–6, partly broken away, and showing the cylinder in fragment and in section.
Figure 11:
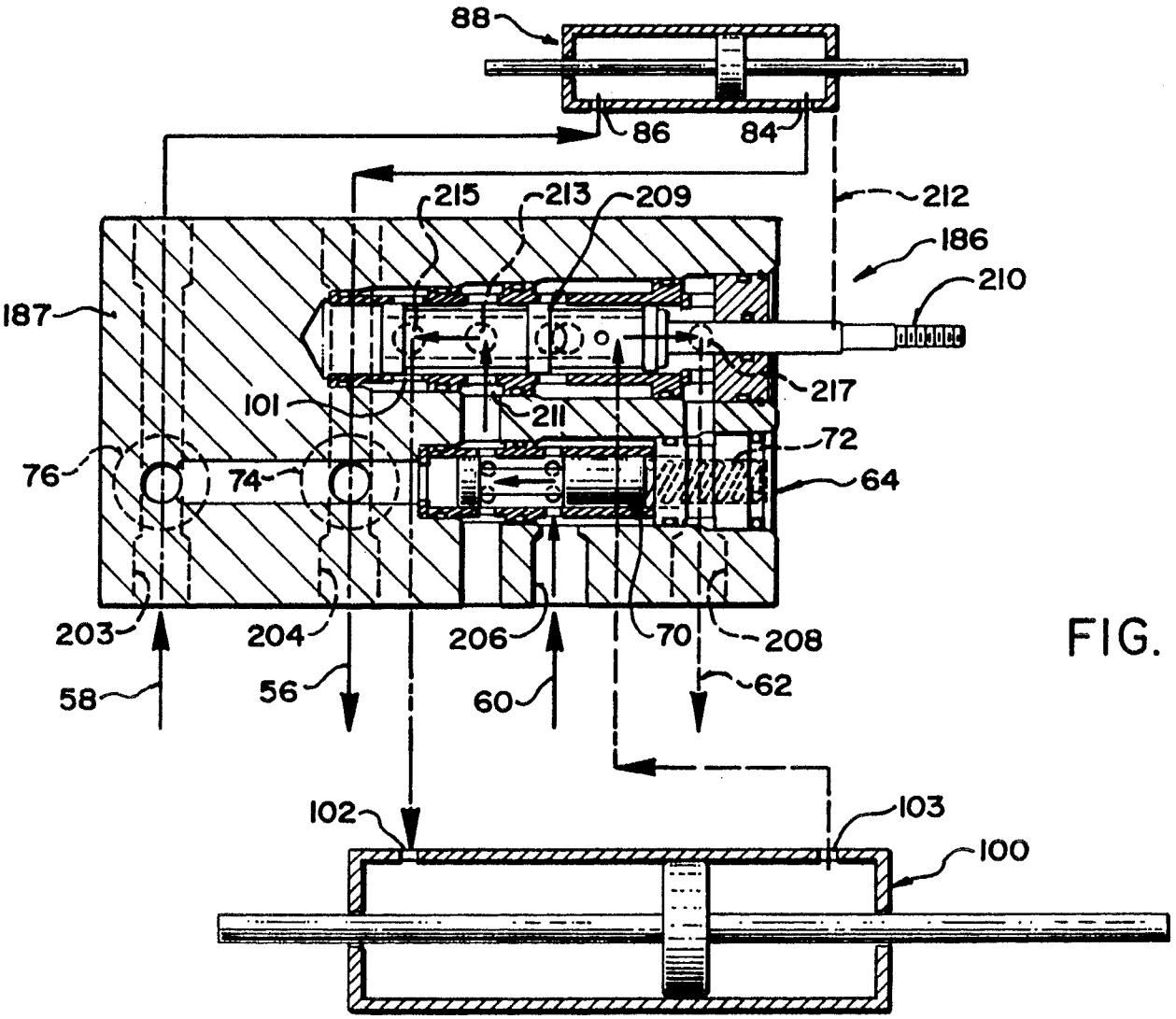
FIG. 11 is a schematic diagram of the servo valve, serve cylinder and steering cylinder with the servo valve in section along line 11—11 of FIG. 3.

Referring to FIG. 2, 4 and 11, the servo valve has an internal spool 209 with shaft 210 connected thereto. There is a member 212 shown in FIG. 2, 3, 4 and 10 which connects the shaft to cylinder 130 of servo actuator 88. As best seen in FIG. 4, the member is generally L-shaped, having first arm 214 with an aperture 216, shown in FIG. 3, for receiving shaft 210 of servo valve 186. A nut 218 secures the member and shaft together.

The member 212 has a second arm 219 provided with a second aperture 220 for receiving cylinder 90 of servo actuator 88. In this example the aperture 220 is elongated, though this is not essential. There is a groove 222 extending circumferentially about cylinder 90 as shown in FIG. 10. There is a screw 224 extending across the second arm 219 above the cylinder 90. The screw is received in the groove 222. When tightened, the screw securely holds the cylinder on the member 212. Because the screw is received in the groove, the cylinder cannot move longitudinally with respect to the member 212.

FIG. 11 shows the connections between the servo valve, servo cylinder and the steering cylinder. As seen, the selector valve 64 in this embodiment is integral with the servo valve in body 187. The drawing illustrates the flow paths of fluid when the servo valve is shifted due to the helm being turned. In this case fluid from the helm enters the body through line 58 and port 203 and passes through the body to the servo cylinder which is thereby shifted to the left from the point of view of FIG. 11. This opens the servo valve so pressurized fluid from line 60 enters through port 206, past selector valve 64 and enters the servo valve through port 211. The fluid passes into the spool 209 itself through opening 213, flows to the left through the spool and passes through opening 215 and port 212 and enters the cylinder through port 102. Return fluid leaves the cylinder through port 103, flows past the spool 70 of the selector valve, enters spool 209 of the servo valve and exits through opening 217, past the selector valve and port 208 and returns to the reservoir through line 67.

As shown in FIG. 2, there are two hydraulic hoses 226 and 228 which connect the valve to each end of actuator 88. Unlike some prior art, no more than these two hoses are required on the assembly 50 itself. Other hoses are used to connect the assembly to the helm, hydraulic pump and reservoir as described above.

VARIATIONS AND ALTERNATIVES

Figure 8:
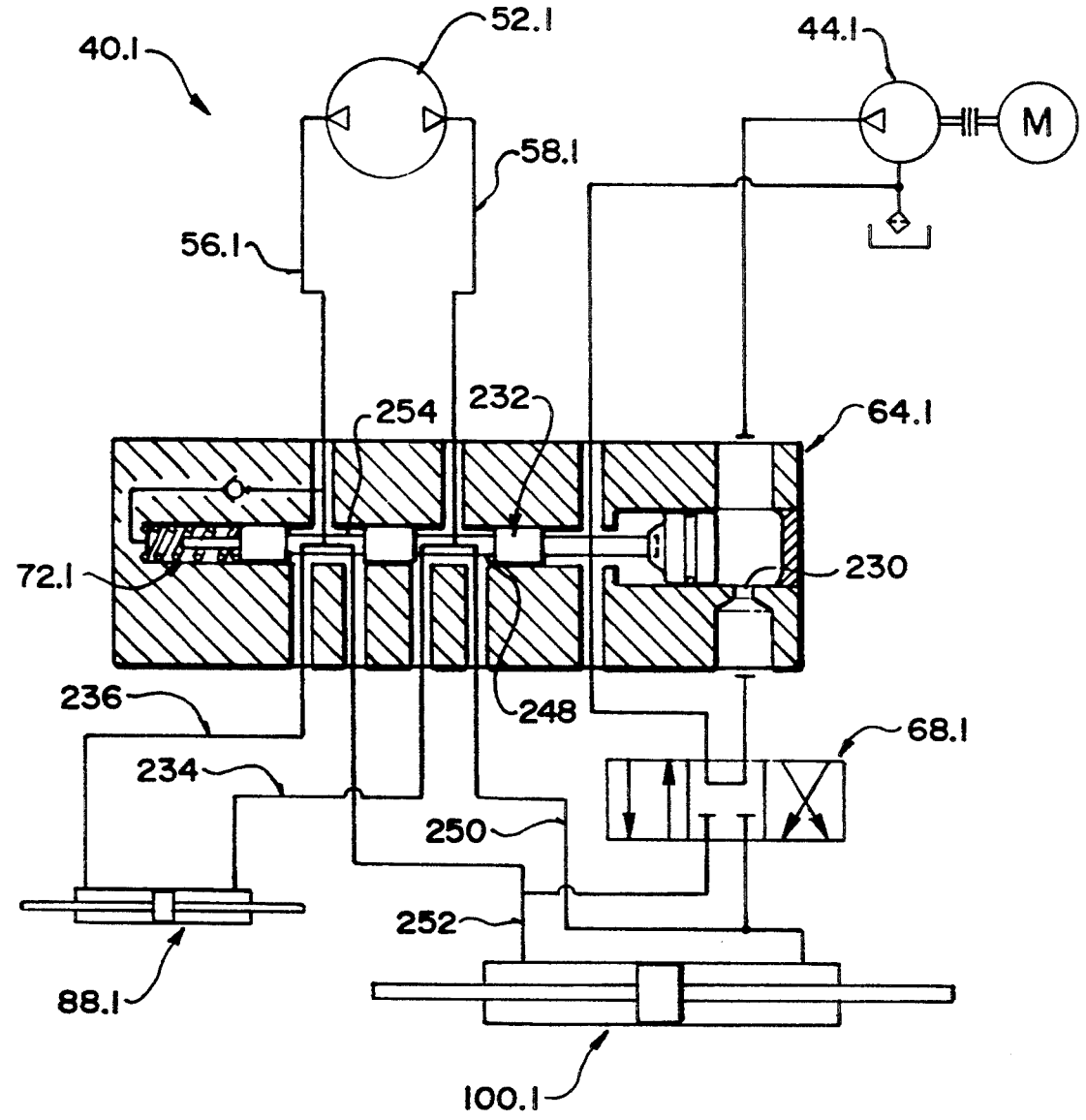
FIG. 8 is a schematic diagram of an alternative power steering system according to the invention, shown in the manual mode.
Figure 9:
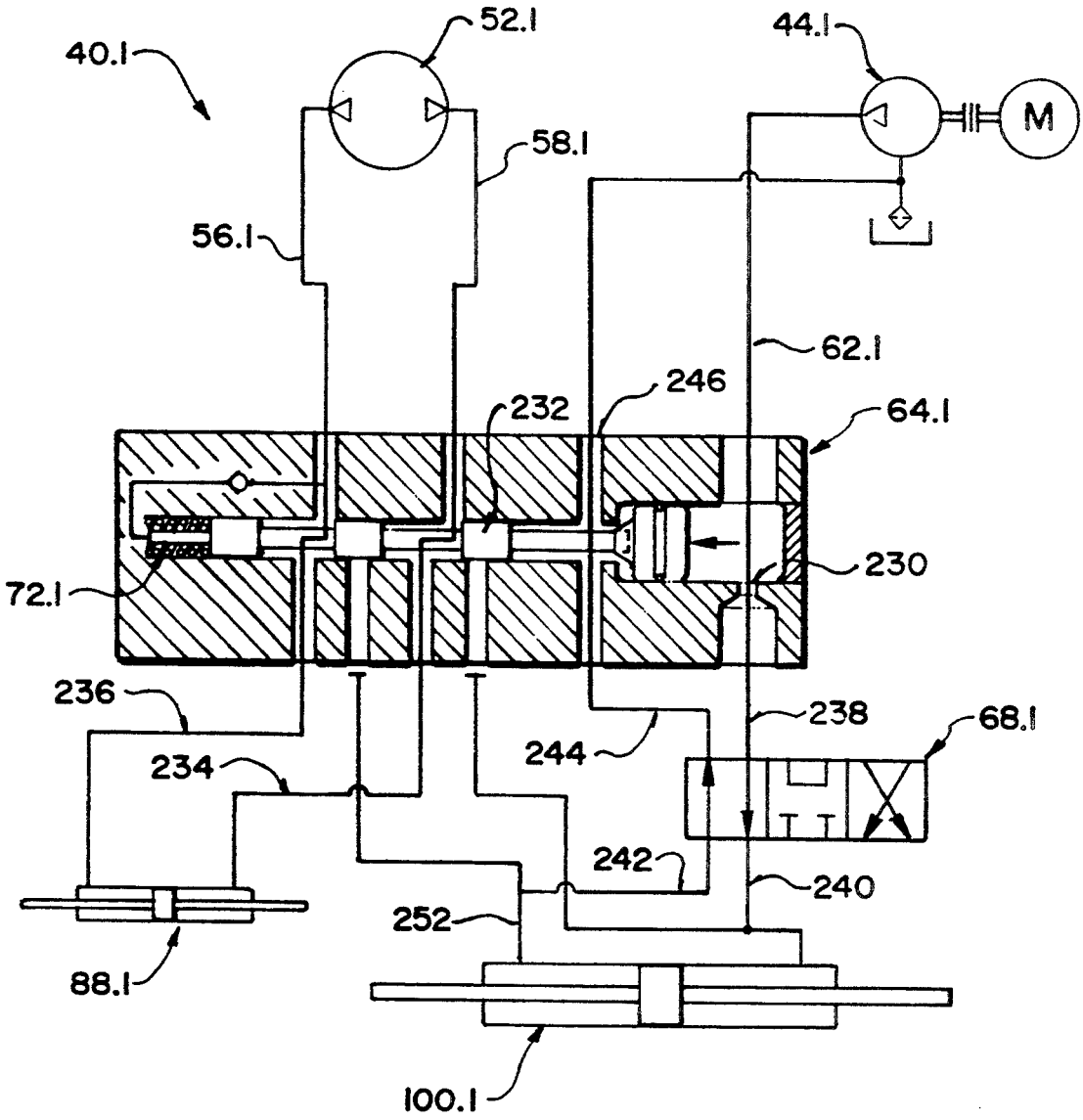
FIG. 9 is a schematic diagram of the embodiment of FIG. 8, shown in the power mode.

FIG. 8 and 9 show a hydraulic steering system 40.1 according to a variation of the invention. Like parts have like numbers with the additional designation "0.1". FIG. 8 shows hydraulic system 40.1 in the manual mode, while FIG. 9 shows it in the power mode. In some earlier systems, when the power pump fails, hydraulic fluid from the helm goes to the servo cylinder and shifts the spool of valve 68.1. When a certain pressure is reached, the sequence spool shifts, causing fluid to go to both the servo cylinder and the steering cylinder. However, all return fluid now goes to the main reservoir. This means that the helm pump is using its make-up check valves to get make-up oil to drive the steering actuator. Since the helm pump has a limited reservoir size, the main reservoir either has to be pressurized or mounted above the helm pump which is quite impractical. The pressurized main reservoir is connected to the bottom of a helm reservoir and the main reservoir pressure pushes oil up to the helm reservoir to replenish the oil that the make-up check valves used. In the embodiment of FIG. 8 and 9, selector valve 64.1 is provided with an orifice 230. This provides a pressure drop which overcomes the pressure of spring 72.1. For example, the pressure drop may be 100 p.s.i. This shifts the spool 232 to the left so that hydraulic fluid from the helm goes only to the servo cylinder when the power pump 44.1 is working.

As seen in FIG. 9 for the power mode, fluid pumped from the helm pump 52.1 through hydraulic line 58.1 passes through the valve 64.1 and leaves through conduit 234 where it enters only the servo cylinder 88.1. Spool 232 blocks fluid flow from the helm to the steering cylinder. Return fluid leaves the servo actuator 88.1 through conduit 236, passes through the valve 64.1 and returns to the helm through hydraulic line 56.1. Pressurized hydraulic fluid from the pump 44.1 enters the valve 64.1 through hydraulic line 62.1, passes through the orifice 230 and enters valve 68.1 through hydraulic line 238. The fluid leaves valve 68.1 and enters the steering actuator 100.1 through hydraulic line 240. The return fluid from the steering actuator 100.1 leaves the cylinder through hydraulic line 242, passes through valve 68.1 and enters valve 64.1 through hydraulic line 244. The fluid leaves the valve through port 246 which is connected to the main reservoir (not shown).

During the manual mode, as shown in FIG.8, fluid pumped from the helm pump 52.1 also passes through the valve 64.1 to hydraulic line 234 and enters the servo actuator 88.1. However, spool 232 has shifted to the right due to the pressure of spring 72.1 and lack of pressure across the orifice, thus opening port 248 and allowing the fluid to pass to the steering actuator 100.1 through hydraulic line 250. Return fluid from the steering actuator returns through hydraulic line 252, passes through the valve past port 254 and returns to the helm through hydraulic line 56.1. Likewise, fluid returns from servo actuator 88.1 through hydraulic line 256, through the valve 64.1 and also returns via hydraulic line 56.1.

It will be understood by someone skilled in the art that many of the details provided above are by way of example only and can be altered or deleted without departing from the scope of the invention which is to be interpreted with reference to the following claims:

What is claimed is:

1. A power steering apparatus for marine craft having a tiller, the apparatus comprising:

an actuator assembly including a hydraulic steering actuator, means for mounting the steering actuator on the craft, means for operatively connecting the steering actuator to the tiller, a hydraulic servo actuator including a servo cylinder with ends, means for mounting the servo actuator on the steering actuator, means for permitting limited axial displacement of the servo actuator relative to the steering actuator and means for mechanically connecting the servo actuator to the steering actuator, the steering actuator includes a steering cylinder, a piston reciprocatingly received in the steering cylinder, a piston rod connected to the piston, and an end fitting on each end of the steering cylinder, the means for mounting the servo actuator including a mount integral with each of the end fittings of the steering cylinder, each said mount including a socket at each end of the steering cylinder slidably receiving one said end of the servo cylinder, the sockets being coaxial with the servo cylinder; and a servo valve mounted on the actuator assembly having means for receiving pressurized hydraulic fluid, means for connecting the valve hydraulically to the steering actuator and the servo actuator and a member mechanically connecting the valve to the servo actuator, whereby displacement of the servo actuator opens the valve to provide pressurized hydraulic fluid to the steering actuator.

2. An apparatus as claimed in claim 1, wherein each said mount and integral end fitting is a one piece component.

3. An apparatus as claimed in claim 1, wherein the means for permitting limited axial displacement of the servo actuator includes portions of the ends of the servo actuator slidably received in the sockets.

4. An apparatus as claimed in claim 3, wherein the means for permitting limited axial displacement further includes shoulders near each said end of the servo cylinder for contacting the mounts and limiting axial displacement of the servo cylinder in either direction from a central position.

5. An apparatus as claimed in claim 1, wherein the servo actuator has a piston with a piston rod connected thereto, the piston rod of the steering actuator and the piston rod of the servo actuator each having an outer end, the means for mechanically connecting the servo actuator to the steering actuator including means for connecting the piston rod of the servo actuator to the piston rod of the steering actuator adjacent the outer ends thereof.

6. An apparatus as claimed in claim 5, wherein the means for connecting the piston rod of the servo actuator to the piston rod of the steering actuator includes a connector having spaced-apart apertures, the rod of the servo actuator being received through a first said aperture and the rod of the steering actuator being received through a second said aperture.

7. An apparatus as claimed in claim 6, wherein the outer end of the rod of the steering actuator has male threads, the means for connecting including a fitting received on the threads.

8. An apparatus as claimed in claim 6, wherein the outer end of the rod of the servo actuator has male threads, the means for connecting including a nut threadedly received on said threads and securing the connector.

9. An apparatus as claimed in claim 1, the member being secured to the servo cylinder.

10. An apparatus as claimed in claim 9, wherein the servo cylinder has a circumferential exterior groove, the member having an aperture fitted about the groove.

11. An apparatus as claimed in claim 10, wherein the valve has a valve spool with a shaft connected thereto, the member being connected to the shaft.

12. An apparatus as claimed in claim 1, wherein the steering actuator includes a steering cylinder having two ends and a port adjacent each said end for hydraulic fluid, the servo valve being mounted adjacent one end of the steering cylinder and having a first port for hydraulic fluid directly connected to a first said port of the steering actuator.

13. A apparatus as claimed in claim 12, wherein the servo valve has a second port for hydraulic fluid connected to a second said port of the steering actuator by a rigid conduit.

14. A apparatus as claimed in claim 13, wherein the rigid conduit is a tube exterior to the cylinder of the steering actuator and co-axial therewith.

15. A marine craft comprising:

a hull having a stern;

a helm mounted within the hull;

a propulsion motor mounted on the hull;

a steering mechanism at the stern of the hull including a tiller;

an actuator assembly including a hydraulic steering actuator, means for mounting the steering actuator on the hull adjacent the tiller, means for operatively connecting the steering actuator to the tiller, a hydraulic servo actuator including a servo cylinder with ends, means for mounting the servo actuator on the steering actuator, means for permitting limited axial displacement of the servo actuator relative to the steering actuator, and means for mechanically connecting the servo actuator to the steering actuator, the steering actuator including a steering cylinder, a piston reciprocatingly received in the steering cylinder, a piston rod connected to the piston, and an end fitting on each end of the steering cylinder, the means for mounting the servo actuator including a mount integral with each of the end fittings of the steering cylinder, each said mount including a socket at each end of the steering cylinder slidably receiving one of said ends of the servo cylinder the sockets being coaxial with the servo cylinder;

a hydraulic pump;

a servo valve mounted on the actuator assembly having means for receiving pressurized fluid, means for connecting the valve hydraulically to the steering actuator and the servo actuator and a member mechanically connecting the valve to the servo actuator, whereby displacement of the servo actuator opens the valve to provide pressurized hydraulic fluid to the steering actuator;

hydraulic conduits connecting the helm to the servo actuator; and hydraulic conduits connecting the hydraulic pump to the servo valve.

16. A power steering apparatus for a marine craft having a tiller, the apparatus comprising:

an actuator assembly including a hydraulic steering actuator having a steering cylinder with a first end and a second end, a first hydraulic port adjacent the first end and a second hydraulic port adjacent the second end, an end fitting adjacent each said end of the cylinder, tie rods connecting the end fittings together, a piston reciprocatingly received within the cylinder and having a piston rod projecting slidably through at least one said end fitting thereof, means for mounting the steering actuator on the craft including a bracket pivotally connected to the end fitting at the first end of the cylinder, means for mechanically connecting the steering actuator to the tiller including a connector on the rod thereof, a hydraulic servo actuator including a servo cylinder having first and second ends, a hydraulic port adjacent each said end of the servo cylinder, a servo piston reciprocatingly received within the servo cylinder and a servo rod connected to the piston of the servo cylinder, means for mounting the servo actuator on the steering actuator including a mount integral with each said end fitting of the steering actuator, each said fitting having a socket co-axial with the servo cylinder for receiving one of said ends of the servo cylinder, means for permitting limited axial displacement of the servo actuator relative to the steering actuator including portions of the servo cylinder adjacent the ends thereof which are slidably received within the sockets and shoulders on the servo cylinder which contact the mounts when the servo cylinder is displaced a predetermined amount in either direction from a central position, and means for mechanically connecting the servo actuator to the steering actuator including a connector connecting the rods thereof together adjacent the outer ends thereof; and a servo valve mounted on the steering actuator adjacent the first said end thereof, the valve having a body, a valve spool reciprocatingly received in the body, a shaft on the spool, ports for receiving pressurized hydraulic fluid, conduits connecting the valve hydraulically to the servo actuator, a first port connecting the valve directly to said first hydraulic port of the steering cylinder, a second port and a rigid conduit connecting the second port of the servo valve to said second hydraulic port of the steering cylinder, and a bracket connecting the shaft of the valve to the cylinder of the servo actuator, whereby displacement of the servo actuator from the central position opens the valve to provide pressurized hydraulic fluid to said port of the steering actuator.

17. A power steering apparatus for marine craft having a tiller, the apparatus comprising:

an actuator assembly including a hydraulic steering actuator, means for mounting the steering actuator on the craft, means for operatively connecting the steering actuator to the tiller, a hydraulic servo actuator including a servo cylinder having a circumferential exterior groove, means for mounting the servo actuator on the steering actuator, means for permitting limited axial displacement of the servo actuator relative the steering actuator and means for mechanically connecting the servo actuator to the steering actuator, the steering actuator includes a steering cylinder, a piston reciprocatingly received in the cylinder, a piston rod connected to the piston, and an end fitting on each end of the cylinder, the means for mounting the servo actuator including a mount integral with each of the end fittings of the steering cylinder;

a servo valve mounted on the actuator assembly having means for receiving pressurized hydraulic fluid, means for connecting the valve hydraulically to the steering actuator and the servo actuator and a member mechanically connecting the valve to the servo actuator, the member having an aperture fitted about the groove of the servo cylinder whereby displacement of the servo actuator opens the valve to provide pressurized hydraulic fluid to the steering actuator.

18. An apparatus as claimed in claim 17, wherein the valve has a valve spool with a shaft connected thereto, the member being connected to the shaft.

19. An apparatus as claimed in claim 1, wherein the servo cylinder has a portion adjacent each end thereof which contacts a portion of said mount slidably receiving said each end when said each end slides towards said mount.

20. An apparatus as claimed in claim 19, wherein the servo cylinder has an end portion of reduced section adjacent said each end thereof, said end portions being slidably received in the sockets.

21. An apparatus as claimed in claim 20, wherein said each portion of the servo cylinder contacting said mount comprises a shoulder on the cylinder adjacent said each end.

22. An apparatus as claimed in claim 1, wherein each said socket slidably receives one entire end of said servo cylinder.

* * * * *